US005092366A

United States Patent [19]

Sakamoto

[11] Patent Number: 5,092,366

[45] Date of Patent: Mar. 3, 1992

[54] AIR PIPE FOR A LIGHTING FIXTURE FOR A VEHICLE

[75] Inventor: Masahiko Sakamoto, Urawa, Japan

[73] Assignee: Stanley Electric Co., Ltd., Japan

[21] Appl. No.: 577,882

[22] Filed: Sep. 5, 1990

[30] Foreign Application Priority Data

Sep. 8, 1989 [JP] Japan ..... 1-105831[U]

[51] Int. Cl.[5] ..... F15D 1/02

[52] U.S. Cl. ..... 138/37; 138/26; 138/39

[58] Field of Search ..... 138/26, 28, 37, 39; 181/264, 269, 279, 280, 281

[56] References Cited

U.S. PATENT DOCUMENTS

| | | | |
|---|---|---|---|
| 366,721 | 7/1887 | Graves | 138/37 |
| 366,919 | 7/1887 | Budd | 138/37 |
| 1,144,306 | 6/1915 | Mock | 138/37 |
| 1,817,958 | 8/1931 | Zwilgmeyer | 138/37 |
| 2,183,561 | 12/1939 | Hamblin | 138/37 |
| 2,647,799 | 8/1953 | Kinney | 138/37 |
| 4,232,762 | 11/1980 | Bschorr | 138/26 |
| 4,747,697 | 5/1988 | Kojima | 138/39 |

*Primary Examiner*—James E. Bryant, III
*Attorney, Agent, or Firm*—Louis Weinstein

[57] ABSTRACT

An air pipe for a lighting fixture for a vehicle, comprising a generally cylindrical pipe formed of an elastic material, the air pipe being provided along its interior with a plurality of integral tongue-like tabs each being inclined at an angle to the longitudinal axis of the pipe, the tabs being provided in a suitably spaced relation and so as to partially overlap at least one of the other tabs to deflect water moving either along or parallel to the center line of the pipe.

5 Claims, 1 Drawing Sheet

AIR PIPE FOR A LIGHTING FIXTURE FOR A VEHICLE

BACKGROUND OF THE INVENTION

1. Field of the Invention

The present invention relates to an air pipe mounted for moderation of a variation in internal pressure on a housing or the like which is of a closed construction of a lighting fixture for a vehicle.

2. Description of the Prior Art

An example of a structure of a conventional air pipe 31 of this kind is shown in FIG. 3. This air pipe 31 is formed of an elastic material such as rubber and molded by using a mold. A plurality of projections 32 are provided in a zigzag fashion on an inner diameter portion 31*a* in order to prevent rain water or the like from entering from outside.

However, even if the air pipe 31 is formed of an elastic material such as rubber which is easily deformed, a portion of the projection 32 is forcibly drawn by great force during molding. This gives rises to a problem in that a service life of a mold is extremely shortened. There is a further problem in that a defect such as a breakage occurs in the portion of the projection 32, resulting in a lowering of yield of the product. These problems should be solved.

SUMMARY OF THE INVENTION

For solving these problems as noted above with respect to the prior art design, the present invention provides an air pipe for a lighting fixture for a vehicle, comprising a generally cylindrical pipe formed of an elastic member, said pipe being provided along its inner surface with a plurality of inclined tongue-like tabs each having a base portion extending in a drawing direction during molding of the pipe, said tabs being provided in a suitably spaced relation and so as not to form a pass-through portion in a direction of a center line of said pipe. Thereby, the forcible drawing state is moderated without impairing water-proof performance to solve the aforementioned problems encountered in prior art.

DESCRIPTION OF THE PREFERRED EMBODIMENT

One embodiment of the present invention will be described in detail hereinafter with reference to the drawings.

Figure 1:
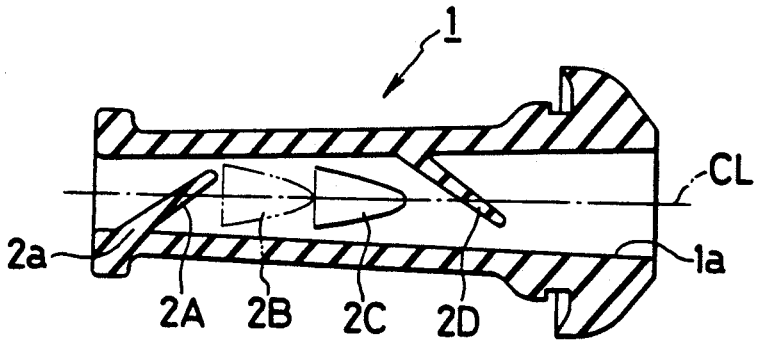
FIG. 1 is a sectional view showing one embodiment of an air pipe according to the present invention.

In FIG. 1, reference numeral 1 designates an air pipe, which is formed of an elastic material such as rubber and molded by a mold, similarly to the conventional example. However, a plurality of, for example, four tabs 2A to 2D provided in suitably spaced relation on the inner surface 1*a* each having a base portion 2*a* integrally connected to the pipe and extending along the inner surface 1*a* in a drawing direction and are projected in the form of a tongue while being inclined so as to form an angle with the longitudinal axis CL.

Figure 2:
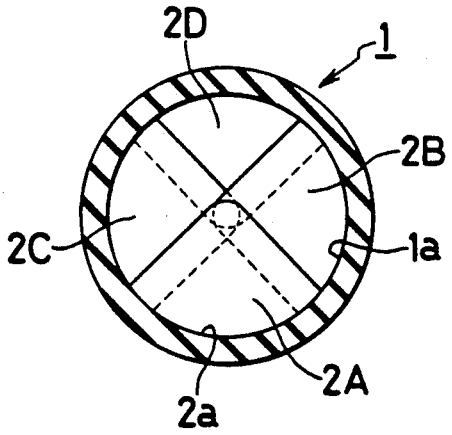
FIG. 2 is an explanatory view showing an example of an arrangement of tabs in the aforesaid embodiment.
Figure 3:
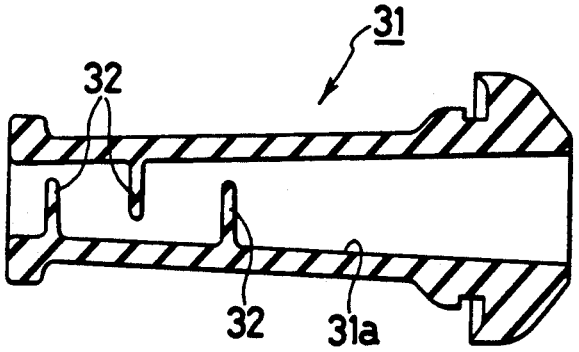
FIG.3 (PRIOR ART)
FIG. 3 is a sectional view showing a conventional example.

FIG. 2 shows an example of positions of the tabs 2A to 2D in which the respective base portions 2*a* are connected to pipe 1 along the inner surface 1*a*, as viewed from the extending direction of a center line CL of the inner surface 1*a*. Each tab, when superimposed upon the surface of FIG. 2 covers an area which is greater than one-fourth (¼) of the total interior surface area bonded by interior surface 1*a*. The base portions 2*a* are arranged so that the tabs 2A to 2D are overlapped in their edges as viewed from the extending direction of the center line CL, that is, so as not to form a pass-through portion to defect water flow and thereby prevent water to flow directly along or parallel to axis CL without striking at least one of the tabs 2A–2D. For example, note that the marginal portion of tab 2A overlaps the marginal portions of tabs 2B and 2C; the marginal portion of tab 2B overlaps tabs 2A and 2D; etc.

As described above, the shape of the tabs 2A to 2D is provided with the base portion 2*a* in the drawing direction and in the form of an inclined tongue. With this arrangement, the forcible drawing state during releasing when the air pipe 1 is molded by a mold is materially moderated. In addition, since the tabs 2A to 2D are arranged so as not to form a pass-through portion, water-proof capability is also obtained.

As described above, the shape of the tabs is provided with the base portion in the drawing direction and in the form of an inclined tongue, and the forcible drawing state during releasing when the air pipe is molded by a mold is materially moderated. This brings forth an excellent effect in that the service life of the mold is materially extended. In addition, since the tabs are arranged so as not to form a pass-through portion, a forcible stress is not applied to the air pipe as a product during releasing without reducing the water proof performance, thus preventing a defect caused by a breakage from occurrence. An excellent effect capable of improving yield is given.

What is claimed is:

1. A one-piece air pipe of enhanced structural strength formed of suitable moldable material for use as an air inlet for a lighting fixture for a vehicle, comprising a generally cylindrical hollow pipe formed of an elastic molding material, said pipe having a longitudinal central axis extending along the center of said pipe and being provided along its inner surface with a plurality of integral inclined tongue-shaped tabs molded integrally with said pipe each having a base portion joined to the pipe and extending in direction which is inclined to the longitudinal axis of the pipe, said tabs each tapering from said base portion toward a free end, so that the base portion is wider than the free end and each being provided in a suitably angular spaced arrangement around the interior of said pipe and so as to partially overlap marginal portions of next adjacent tabs to deflect matter moving along or parallel to the longitudinal axis in a direction of a center line of said pipe so as not to form a pass-through portion in a direction of the longitudinal central axis of said pipe while permitting the free flow of air therethrough, said tabs being inclined in the direction aligned with the drawing direction employed during molding of the air pipe to prevent breakage of said tabs.

2. An air pipe for a lighting fixture for a vehicle according to claim 1, wherein said elastic material comprises rubber.

3. A solid, one-piece air pipe for a lighting fixture formed of a suitable moldable material, comprising:

a generally cylindrical hollow pipe formed of an elastic moldable material and having a longitudinal central axis extending along the center of the pipe;

a plurality of integral tongue-shaped tabs joined at spaced intervals along the interior surface of said pipe and each being inclined at an angle to the longitudinal axis of said pipe, said tabs having a wide base portion tapering to a narrow free end;

said tabs being oriented about the interior of said pipe at angles offset from one another so that a marginal portion of each tab overlaps the marginal portions next adjacent tabs so that matter entering said pipe and moving in a direction parallel to the longitudinal of the axis of said pipe will strike and be deflected by at least one of said tabs so as not to form a pass-through portion in a direction of the longitudinal central axis of said pipe while permitting the free flow of air therethrough, said tabs being inclined in the direction aligned with the drawing direction employed during molding of the air pipe to prevent breakage of said tabs.

4. The air pipe of claim 3 wherein the superimposed image of each of said tabs upon a planar surface perpendicular to the longitudinal axis of the pipe covers an area greater than (1/N)th of the surface area bounded by the interior surface of said pipe wherein N is equal to the number of tabs provided within said pipe.

5. The air pipe of claim 4 wherein the number of tabs is equal to four (4).

* * * * *